United States Patent [19]

Wegele et al.

[11] 4,345,907

[45] Aug. 24, 1982

[54] PROCESS OF APPLYING DYESTUFFS AND/OR CHEMICALS OR FINISHING MATERIALS TO TEXTILES, FIBROUS PRODUCTS, SHEET MATERIALS, PAPERS OR FLEECES

[75] Inventors: Günther Wegele, Iffeldorf; Gerhard Brink, Münchberg; Goetz Rotta, Weinheim; Manfred Roeth, Ludwigshafen; Siegfried Wittmann, Mannheim, all of Fed. Rep. of Germany

[73] Assignee: Chemische Fabrik Theodor Rotta GmbH & Co. KG, Mannheim, Fed. Rep. of Germany

[21] Appl. No.: 973,576

[22] Filed: Dec. 27, 1978

[51] Int. Cl.[3] ..... D06P 5/20

[52] U.S. Cl. ..... 8/444; 427/13

[58] Field of Search ..... 8/2; 427/13, 27, 30, 427/DIG. 12

[56] References Cited

U.S. PATENT DOCUMENTS

| | | | |
|---|---|---|---|
| 2,773,472 | 12/1956 | Lamm | 427/13 |
| 3,016,876 | 1/1962 | Sedlacsik | 427/30 |
| 3,782,895 | 1/1974 | Goorhuis | 8/2 |
| 3,941,559 | 3/1976 | Cunnane et al. | 8/2 |
| 3,961,878 | 6/1976 | Capponi et al. | 8/2 |

*Primary Examiner*—Lewis T. Jacobs

*Attorney, Agent, or Firm*—Staas & Halsey

[57] ABSTRACT

A process of applying dyestuffs and/or chemicals or finishing materials to textiles, fibrous products, sheet materials, papers or fleeces characterized in that said dyestuffs and/or chemicals are applied in the electrostatic field.

11 Claims, 1 Drawing Figure

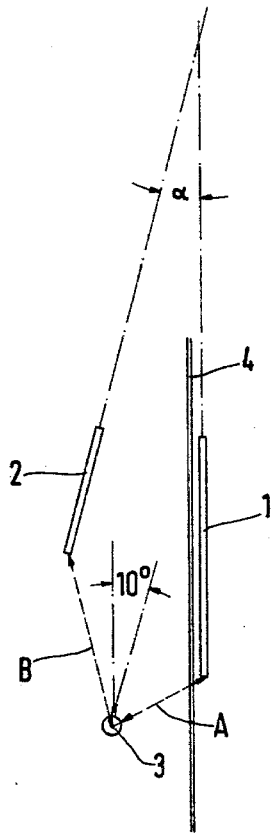
α
4
2
1
10°
B
A
3

PROCESS OF APPLYING DYESTUFFS AND/OR CHEMICALS OR FINISHING MATERIALS TO TEXTILES, FIBROUS PRODUCTS, SHEET MATERIALS, PAPERS OR FLEECES

BACKGROUND AND SUMMARY OF INVENTION

The invention relates to a novel process representing a real contribution to the art of applying dyestuffs and/or chemicals or finishing agents to textiles, fibrous products, sheet materials, papers or fleeces.

Dyestuffs or chemicals are generally applied to textiles by letting the fabrics undergo a saturation treatment through immersion or padding in a liquid bath, after which the excess liquor is pressed out and the fabrics dried. If the cloth has been impregnated with resins, the latter are cured, usually during the drying or also after the drying. However, in the padding process it is a disadvantage that the cloth must be completely dipped into the padding liquid, the take-off speed being dependent upon the drying process. In addition, large quantities of water are required for drying the cloth, resulting in high cost.

Attempts have been made to overcome the disadvantages of the padding method for applying finishing materials to textiles by spraying the chemicals or dyestuffs dispersed in liquids. To spray textiles with chemicals or liquid dyestuffs, it is common practice to apply these substances via spray heads or guns that utilize compressed air as a means for carrying the dyestuffs or chemicals. Thus, German Pat. No. 950 187 recites such a process and a device for imparting colorfastness to colored textiles and the like, whereby the liquid is atomized as a mist with the aid of a jet of air serving at the same time as a means for delivering the mist. Likewise, the printed publication of German Unexamined Patent Specification No. 241 6 221 recites a spray method for applying finishing agents, wherein a concentration of the finishing is atomized on the material as a fine watery spray produced in a device employing compressed air.

These well-known spray methods obviate the drawbacks of the padding method, but they themselves have serious disadvantages. With the known spray technology using compressed air as carrier, it is impossible to coat textiles uniformly with dyestuffs and/or chemicals or finishing agents. Turbulences arise at the interface between two different atomizing cones, resulting in uneven coating. Likewise, turbulences can be formed within an atomizing cone directly on the outlet edge of the nozzle, which may lead to uneven distribution of the sprayed material within an atomizing cone.

Therefore, the major purpose of the invention is to provide a process of the type mentioned at the outset, by which textiles, fibrous products, sheet materials, papers or fleeces can be uniformly coated with dyestuffs and/or chemicals or finishing agents.

The above object is solved according to the invention by applying the dyestuffs and/or chemicals in the electrostatic field, that is, by attracting the dyestuffs and/or chemicals to the object to be painted by an electrostatic potential.

According to a preferred embodiment of the invention, the process is carried out in the indirect electrostatic field, that is, the process makes use of indirect electrostatic potential.

Another preferred embodiment of the process of the invention employs the hydraulic spray method known as airless spraying, wherein the liquid is atomized under very high pressure without air as carrier medium and only the minimum quantity of the liquid necessary for solving the dyestuffs or chemicals is atomized and applied to the textiles.

A further preferred embodiment of the invention uses equipment with two-fuel spray nozzles.

A great number of techniques representing a real contribution to the art can be achieved with the process provided by the invention.

The process according to the invention permits higher production rates in all fields of application. It is distinguished by an enormously reduced water consumption, far below the proportions employed in the padding technique. Moreover, the cost of energy is significantly lowered, since less moisture has to be evaporated in the drying zone, which results in a lower cost per meter produced.

The process according to the invention can be employed in all semi- or fully continuous methods independently of the nature of the materials which, for example, may consist of spun yarns, flocks, non-woven fabrics, warp yarns, woven fabrics, or knitted goods, as well as fleeces.

A special advantage of the process of the invention lies in the fact that, unlike the padding method, there is no need for squeeze rollers and, thus, processing with high liquor concentrations is possible without the risk of liquor breakdown, such as occurs in the processes heretofore employed.

Another important advantage of the method of the invention lies in the fact that dyestuffs and/or chemicals or finishing agents, as the case may be, can be applied to materials that are inherently very sensitive to pressure, such as velvet or crepe, without changing the appearance of the goods, that is to say, the process of the invention does not deleteriously affect print-sensitive materials and does not alter their piles.

The process provided by the invention can be carried out in existing systems, after certain modifications, as well as in combination with any kind of heating, drying, fixing, and condensing methods.

The process of the invention may be carried out with electronic control, thus enabling smooth interoperation between discharge assembly and evaporation section.

A further advantage of the process according to the invention is the reduction in chemical consumption.

A special advantage of the method provided by the invention is the fact that, as required, the finishing and/or application of chemicals and/or dyestuffs and/or auxiliary agents can be effected either on the surface or in the core of the goods to be coated and also on the surface, as well as in the core simultaneously.

A further advantage of the process embodying the principles of the invention is the fact that the necessary setting periods are shorter than in the padding technique.

In difficult cases where various liquors with limited compatibility must be applied, the invention permits simultaneous application without the risk of a liquor breakdown.

An additional field of application is provided for a combined operation, e.g., with the naphthalating process, as a consequence of invention-induced economizing of a drying operation between impregnating and final dyeing.

Due to the constantly even coating of the product made possible by the process of the invention, maximum uniformity and, thus, optimum final quality of fabric, both in length and in width of the goods, can be attained.

With regard to the coating of dyestuffs and/or chemicals or finishing agents in partial widths, the method of the invention provides a new field of application that cannot be handled by the padding technique.

Finally, a special advantage is seen in the fact that unlike, for example, padding there are no leveling problems to contend with, even with the greatest possible working widths.

The practical application of the process according to the invention also results in better creasing angles and abrasion resistance for all types of textiles and non-woven fabrics.

In recapitulation, the following can be stated: The great advantage of the method of the invention over the familiar spray methods employing compressed air is the fact that the dyestuffs, chemicals or other finishing materials can be applied very evenly to the textiles. In addition, this method reduces considerably the cost of power consumption for drying purposes heretofore necessary for padding the material.

Furthermore, better hydrophobic effects can be attained with this process. Heretofore, certain finishing materials, such as non-water-soluble emissions, could only be applied with an emulsifier. However, this emulsifier had a disturbing effect on the appearance of the finished product, e.g. in the case of hydrophobic finishing. It is now possible to apply these materials with a lesser amount of emulsifier and without water.

Another advantage of this process lies in the treatment of goods that cannot be padded, e.g. knitted goods. For example, for better dyestuff absorption they may be sprayed with caustic soda prior to dyeing, using suitable wetting agents and, where necessary, also thickeners in order to obtain optimum distribution of the liquid in the atomizing cone. Knitted goods shrink considerably during the treatment on a padding mangle, so that the original width cannot be maintained. This can be fully avoided by the process according to the invention.

Moreover, the method according to the invention has the advantage that textiles can be dyed or treated on one side only, for example, in order to obtain certain effects or color runs, e.g. in materials known as degrade fabrics in which a color run from one side to the other is desirable.

Furthermore, finishing materials made from artificial resins can be applied through atomization to obtain the familiar crease-resistant, self-smoothing properties of the fabric and abrasion resistance. Excellent creasing angles can be obtained with small amounts of coatings of finishing agents made from artificial resins.

Advantageously, the method of the invention can also be employed for water-repellent finishing. Particularly, water-repellent finishing can be effected with small amounts of emulsifiers that counteract the water-repellent effect. Moreover, one-sided application of water-repellent finishing is possible here, so that the water-repellent effect of the material can advantageously be achieved from one side only, while the other side, e.g. the inner surface of garments, continues to "breathe".

Furthermore, finishing agents can be made with this method that give a hand (or handle) to the fabric. In certain materials a rough or smooth feel of the surface is desirable. In this case, one-sided application of the textile finishing material can achieve effects that heretofore have not been possible with the dipping technique.

Another preferred field of application of the process according to the invention consists in a uniform application of textile lubricants in the spinning mill.

Sizing along the principles of the invention reduces the cost of power consumption for drying.

In a practical embodiment of the invention, airless spray guns are employed under high pressure to carry out the process of the invention to apply dyestuffs and/or chemicals or finishing materials to the textiles being treated for the purpose of pretreating, bleaching, dyeing or finishing them. Only the minimum amount of liquid needed to disperse the dyestuff or to solve the chemicals or the other textile finishing agents need be sprayed, so that high concentrations of the dyestuffs, chemicals or other textile finishing agents are obtained.

In another practical embodiment of the invention, a plurality of such airless spray guns may be employed in a row along the width of the web of fabric.

Preferably, the liquids, chemicals or other finishing materials have a high surface tension for the formation of droplets, as well as a low viscosity (ranging from 20 to 100 cp).

A further advantage is the fact that the dyestuffs and/or chemicals or the other finishing agents can be coated in accurately measured batches.

BRIEF DESCRIPTION OF THE DRAWING

The single FIGURE of drawing is a schematic representation of the present invention.

The following sections will discuss a particularly advantageous development of the process of the invention. The spray nozzle is arranged in an inclined position laterally of the electrode, whereby the material to be sprayed issuing from the spray nozzle enters the space between the electrode and the textiles or fleeces to be sprayed.

Thus, care is taken in this process that the material to be sprayed does not make contact with the live components and that it is deposited in the best way possible on the textiles or fleeces.

In a preferred embodiment of the process of the invention, the object to be sprayed consists of a textile or fleece web which is continuously transported in one direction and whereby advantageously at least one spray nozzle, viewed in the direction of movement of the web, is aligned laterally of the high-voltage element. There is arranged, either between two transporting rollers on the back of the object to be sprayed, face to face with the electrode, a grounded flat, smooth electrode, or said electrode lies opposite the surface of a grounded transporting roller. Since in this practical embodiment of the invention the suction of the continuous textile or fleece web supports the entry of the material to be sprayed into the indirect stress field the spraying, if necessary, can also be carried out for the first time without compressed air.

The nature of the present invention will now be discussed with reference to the test evaluations below. Preliminary remark: The test was carried out with an airless spray gun with corresponding pumping unit in the indirect electrostatic field.

The applied indirect electrostatic field had a voltage of 10 to 180 KV, the fusing was 5 mA.

The grounded electrode on the back of the cloth consists of a $V_4A$ sheet steel, the distance between cloth and counter electrode is kept to a minimum.

The electrode with the impressed voltage is a grid electrode comprising a $V_4A$ steel frame in which grid wires are stretched at a distance of less than 10 cm in the direction of movement of the cloth and perpendicular thereto. The minimum distance to the grounded machine parts is 20 cm. The spray nozzles are not energized.

The following products were employed for testing the liquor stability:

Rotta-finish 200=bathotonic acrylate dispersion
RO-MA-SILICONE 414=silicone emulsion
Rotal 440=paraffin wax emulsion
Drywear 510=methylol compounds of urea and cyclic ureas
Preskasin 531=methylol compounds of urea derivatives
F-Donator 505=urea-formaldehyde compounds
Dipolit 654=non-ionic fluorocarbon emulsion The products were stable, so there are no objections as far as liquor stability is concerned.

1. Spray tests were carried out with RO-MA-SILIKON 414 in conjunction with Rotta-Fix 264 on the "Lille" fabric (polyestercotton fibrous material) of the firm of Ploucquet, Heidenheim.

Formula:
30 g/l RO-MA-SILIKON
9 g/l Catalysator 464
50 g/l Rotta-Fix 264
5 g/l Catalysator 599

The liquor absorption in two different tests was 32.5 and 27.0%. The cloth was dried and subsequently condensed in a Benz equipment. The test was taken with the maximum running speed of the Benz drier. Heating occurred at 120°, the condensation lasted for 4 minutes at 150°.

Other tests were taken with twice the liquor concentration. An attempt was made to reduce the amount of coating by one-half, starting from 33.4%. The closest was 23.3% and subsequently 10% liquor absorption. The liquor absorption depends on the pressure in front of the nozzle and on the nozzle size, as well as on the speed of the cloth.

The results of the tests are apparent from Table I below.

To reduce the impregnation of the cloth and to apply the finishing definitely on one side of the cloth, thickeners were employed during the test.

2. Finishing tests with Drywear 501 with Rotta-Finish 201:

Formula:
150 g/l Drywear 510
40 g/l Catalysator 590
50 g/l Rotta-Finish 200.

Cloth: pure cotton (Contonova fabric), liquor absorption 45.7%. The test results are summarized in Table II below.

Drying and condensation occurred in the usual manner. The liquor absorption was 45.7% with the standard liquor concentration, subsequently twice the concentrated solution was employed, again with a view to reducing the liquor absorption by one half.

3. Finishing tests with Preskasin 531:

Formula:
150 g/l Preskasin 531
15 g/l Catalysator 598
30 g/l Badena 242.

Cloth: Rayon satin was used as finish. Amount of coating 43%.

In another test, the amount of coating was reduced to 37% and in the next test the liquor absorption was 26%. Differences in the amounts of coating were obtained by varying the inlet pressure in front of the nozzle.

The test results are summarized in Table III below.

Here too, the tests were prepared with double-concentrated solutions. With the double-concentrated solution the liquor absorption was (1) 20.7%; (2) 18.5%; (3) 12.7% and (4) 8.1%.

The test results are summarized in Table IV below.

In comparison with the padded fabric, the water-repellent effect during spraying increased from 5 to 4, the water flow from 15 to 25 ml, and the water absorption from 6.7 to 13.1%, that is to say, the reduced amount of coating became noticable. With the double concentration and 34% liquor absorption the water-repellent effect was 5, the water flow 5 ml and the water absorption 6.8%. With 23% liquor absorption, the water-repellent effect was 5, the water flow 15 ml, and the water absorption 7.6%. These values must be called excellent for the fabric employed. Upon reducing the liquor absorption to 10%, the water-repellent effect was 5, the water flow 140 ml, and the water absorption 15.8%.

When finishing the Cotonova fabric with Drywear 510, the following values were obtained: dry creasing angle during padding 110/121, during spraying 106/105. The wet creasing angle during padding 131/130, during spraying 131/129. Tearing strength in the warp 39.6 kp, weft 26,7 kp. After spraying the tearing strength was 66.4 kp in the warp, weft 52.9 kp.

The following should be noted when finishing cotton satin with Preskasin 531: dry creasing angle during padding 75/92, wet creasing angle 98/110, during spraying: dry creasing angle 121/111, wet creasing angle 81/95. With double concentration of Preskasin 531 during padding: dry creasing angle 139/145, wet creasing angle 122/100. After spraying: 98/108 and wet creasing angle 67/85.

A practical embodiment of the process of the invention is shown below with reference to the accompanying figure, which is a schematic representation.

In this FIGURE, the ground electrode is denoted by the reference numeral 1 and the electrode (e.g., a gridded electrode) by the reference numeral 2. The nozzle pipe, i.e., the pipe on which the nozzles are located, has the reference numeral 3. The web carried, for example, by rollers and on which dyestuffs and/or chemicals or finishing materials are applied, is indicated by the reference numeral 4.

The distance A is the distance between the nozzle pipe 3 and the bottom edge of the gound electrode 1.

B is the distance between the nozzle pipe 3 and the bottom edge of the electrode 2.

The electrode angle $\alpha$ is the acute angle between the ground electrode 1 and the electrode (e.g. netted electrode 2).

The present invention is based on the knowledge that the behavior of the atomizing cone and, thus, the behavior of the entire nozzle pipe is dependent on the relation between the distances A:B, for if A:B=1:1, material would be drawn from the bottom one-third of the atomizing cone and deflected to the electrode. However, if A:B is greater than 1:2, the entire spray jet is deflected to the ground electrode and, thereby, to the web.

If A:B = 1:2, we have a border case. If this ratio is less than 1:2, the spray jet is partly deflected to the electrode.

Another important aspect of a preferred embodiment of the invention is the vertical adjustment of the electrode network; if the electrode lies too deep, the upper quarter of the spray jet is deflected insufficiently and goes over the ground electrode, so that this component of the spray jet can no longer be construed by the electric field.

The electrode adjusting angle $\alpha$ should not be too acute in relation to the ground electrode because of a possible spark discharge. For example, a 15 cm spacing from the upper electrode rim to the ground electrode is of advantage.

If the electrode is adjusted parallel to the ground electrode, a portion of the spray jet is deflected toward the electrode, because the ratio of A:B approximates 1:1.

According to a preferred embodiment of the invention, the optimum electrode angle lies between 20° and 30°. Preferable spray conditions in connection with the process and device conditions shown schematically in the accompanying figure are:

Electric field: 150,000–180,000 V

Pressure: 25 bar

Nozzle position: 10° deviation from the perpendicular (line C) line D in the direction of the ground electrode.

According to a further practical embodiment of the invention, the tilt of the nozzles of the nozzle pipe 3 to the perpendicular electrode 1 is about 10°.

TABLE I

Finishing Formula: 30 g/l RO-MA-SILIKON 414; 9 g/l Catalysator 464; 60 g/l Rotta-Fix 264; 6 g/l Catalysator 599

| Test according to Bundesmann | Padding liquor absorption 67% | Liquor absorption 34.4% | Spray liquor absorption 23.3% | Liquor absorption 10% |
|---|---|---|---|---|
| Water absorption (%) | 6.7 | 6.8 | 7.6 | 15.8 |
| Water flow | | | | |

TABLE I-continued

Finishing Formula: 30 g/l RO-MA-SILIKON 414; 9 g/l Catalysator 464; 60 g/l Rotta-Fix 264; 6 g/l Catalysator 599

| Test according to Bundesmann | Padding liquor absorption 67% | Liquor absorption 34.4% | Spray liquor absorption 23.3% | Liquor absorption 10% |
|---|---|---|---|---|
| (ml) | 15.0 | 5.0 | 15.0 | 140.0 |
| Water-repellent effect | 5.0 | 5.0 | 5.0 | 5.0 |

TABLE II

Finishing Formula: 150 g/l Drywear 510; 40 g/l Catalysator 590; 50 g/l Rotta-Finish 200

| Technological test | Padding liquor absorption 67% | | Spray test liquor absorption 45.7% | |
|---|---|---|---|---|
| | Warp | Weft | Warp | Weft |
| Dry creasing angle | 110 | 121 | 106 | 105 |
| Wet creasing angle | 131 | 130 | 131 | 129 |
| Tearing strength | 39.6 | 26.7 | 66.4 | 52.9 |

TABLE III

Finishing Formula: 150 g/l Preskasin 531; 15 g/l Catalysator 598; 30 g/l Badena 242

| Technological Test | Padding Liquor absorption 65% | | Liquor absorption 43% | | Spray test absorption 37% | | Liquor absorption 26.7% | |
|---|---|---|---|---|---|---|---|---|
| | Warp | Weft | Warp | Weft | Warp | Weft | Warp | Weft |
| Dry creasing angle | 75 | 92 | 121 | 111 | 80 | 79 | 94 | 102 |
| Wet creasing angle | 98 | 110 | 81 | 95 | 61 | 101 | 77 | 86 |

TABLE IV

Finishing Formula: 300 g/l Preskasin 531; 30 g/l Catalysator 598; 60 g/l Badena 242

| Technological Test | Padding liquor absorption 65% | | Liquor absorption 20% | | Liquor absorption 18.5% | | Spray test liquor absorption 12.7% | | Liquor absorption 8.1% | |
|---|---|---|---|---|---|---|---|---|---|---|
| | Warp | Weft | Warp | Weft | Warp | Weft | Warp | Weft | Warp | Weft |
| Dry creasing angle | 139 | 140 | 98 | 108 | 104 | 80 | 106 | 120 | 123 | 111 |
| Wet creasing angle | 122 | 100 | 67 | 85 | 60 | 98 | 63 | 82 | 56 | 71 |

We claim:

1. A process of applying dyestuffs and/or chemicals or finishing materials to textiles, fibrous products, sheet materials, paper or fleeces, characterized in that said dyestuffs and/or chemicals or finishing materials are applied indirectly in an electrostatic field between a high-voltage grid electrode and a grounded electrode, and are applied substantially perpendicular to said electrostatic field.

2. A process according to claim 1, characterized in that said dyestuffs and/or chemicals or finishing materials are applied in the electrostatic field through atomization.

3. A process according to claim 2, characterized in that said dyestuffs and/or chemicals or finishing materials are applied via hydraulic spraying.

4. A process according to claim 3, characterized in that said dyestuffs and/or chemicals or finishing materials are applied via at least two-fuel spray nozzles.

5. A process according to claim 4, characterized in that a spray nozzle is employed which is arranged in an inclined position laterally of the electrodes, whereby the material to be sprayed issuing from said spray nozzles enters the space intermediate between said grid electrode and the textiles, fibrous products, sheet materials, papers or fleeces to be sprayed without penetration of said grid electrode.

6. A process according to claim 5, wherein the object to be sprayed consists of a web of textile, fibrous product, paper, fleece or another sheet material, wherein at least one of said spray nozzles, viewed in the direction of movement of the web, is aligned laterally of the high-voltage grid electrode.

7. A process according to claim 6, characterized in that the processing is carried out such that the grounded electrode is flat is arranged intermediate between two transporting rollers on the back of the object to be sprayed face to face with said grid electrode.

8. A process according to claim 6, characterized in that the processing is carried out such that said grid electrode lies opposite the surface of a grounded transporting roller.

9. A process according to claim 7, characterized in that the relation between a distance from the bottom of said grounded electrode to said spray nozzle and a distance from the bottom of said high-voltage grid electrode to said spray nozzle is greater than 1:2.

10. A process according to claim 9, characterized in that the angle $\alpha$ of said grid electrode and said grounded electrode varies between 20° and 30°.

11. A process according to claim 10, characterized in that the tilt of the nozzles of said nozzle pipe relative to said perpendicular ground electrode is about 10°.

* * * * *